US008123467B2

(12) United States Patent
Lin

(10) Patent No.: US 8,123,467 B2
(45) Date of Patent: Feb. 28, 2012

(54) FAN DEVICE WITH A VIBRATION ATTENUATING STRUCTURE

(75) Inventor: Chun-Ju Lin, Taoyuan (TW)

(73) Assignee: Enermax Technology Corporation, Taoyuan (TW)

( * ) Notice: Subject to any disclaimer, the term of this patent is extended or adjusted under 35 U.S.C. 154(b) by 400 days.

(21) Appl. No.: 12/402,652

(22) Filed: Mar. 12, 2009

(65) Prior Publication Data

US 2010/0158671 A1 Jun. 24, 2010

(30) Foreign Application Priority Data

Dec. 19, 2008 (TW) ..... 97222809 U

(51) Int. Cl.
*F01D 5/00* (2006.01)

(52) U.S. Cl. ..... 415/119; 415/121.3

(58) Field of Classification Search ..... 415/119, 415/121.3
See application file for complete search history.

(56) References Cited

U.S. PATENT DOCUMENTS

2007/0231142 A1* 10/2007 Liu et al. ..... 416/189
2007/0248460 A1* 10/2007 Su ..... 415/213.1
* cited by examiner

*Primary Examiner* — Trung Q Dang
(74) *Attorney, Agent, or Firm* — Chun-Ming Shih

(57) ABSTRACT

A fan device with a vibration attenuating structure is disclosed. The fan device with a vibration attenuating structure comprises a fan and a frame covering the fan. The frame entirely covers the fan, and two opposing sides of the frame have an opening thereon. The openings are corresponding to blades of the fan to form the flowing path of the air. As above-mentioned, the frame performs as a buffering member for attenuating the vibration of the fan so as to prevent the noise generated by the vibration.

13 Claims, 6 Drawing Sheets

FAN DEVICE WITH A VIBRATION ATTENUATING STRUCTURE

CROSS-REFERENCE TO RELATED APPLICATION

This application claims priority under 35 U.S.C. § 119 to Taiwan Patent Application No. 097222809, filed on Dec. 19, 2008, in the Taiwan Intellectual Property Office, the entire contents of which are hereby incorporated by reference.

BACKGROUND OF THE INVENTION

1. Field of the Invention

The present invention relates to a fan device and in particular to a fan device with an elastic frame for reducing vibration.

2. Description of Related Art

Depending on the development of the technology, the command for processing data is increasing. Thus, the personal or commercial computers have to be upgraded for processing data by high performance CPU and high capability of hard disk and memory units so that large amounts of data can be processed and transferred.

However, the primary devices of computer system usually generate much heat and it is necessary for dissipating the heat with high efficiency. Generally speaking, high speed fan is used for cooling CPU, but noise is simultaneously generated by the fan. In other words, the cooling units, such as fan, heat sink, and conduct pipe are used for dissipating the heat from the computer system, but the noise issue always takes influence on users.

However, the traditional fan structure has following disadvantages.

1. Fan noise can be transmitted (1) from the inlet and outlet of the fan; (2) from parts of the fan; (3) from vibration of parts attached to the fan. Factor (1) generates primary noise, and the noise generated from factor (3) also bothers users because that the resonance of the fan in the housing of the computer generates low frequency noise. In other words, the factors of balance of fan blades, balance of motor and the axle structure generate the vibration of fan so that the resonance of the fan and the casing will produce noise. Accordingly, the repeated mechanical movement (so-called vibration or oscillation), especially in engine, motor or turbine will produce noise because of the vibration. For example, the cooling fan or the compressor of air conditioners generates noise. Moreover, a severe vibration may cause the failure of the equipment or the structure.

2. Elements may be used for attenuating the vibration on the fan structure. For example, spacers can be disposed between the fan and the casing. However, spacers cannot be easily assembled and spacers usually consist of a small piece of elastic material so that they can be lost in the assembling process. Another method is providing plastic riveting for buffering the vibration from the casing, but there are still problems of cost and assembling.

Therefore, in view of this, the inventor proposes the present invention to overcome the above problems based on his expert experience and deliberate research.

SUMMARY OF THE INVENTION

The primary object of the present invention is provided for a fan device with a vibration attenuating structure. The fan device with a vibration attenuating structure has an elastic frame for entirely holding the fan so that the vibration of the operation of the fan is isolated from the casing. Therefore, the noise generated by the vibration the fan and the casing is reduced and the quiet environment is achieved.

Another object of the present invention is provided for preventing the vibration of the fan from the electronic devices, such as hard drive disk in the casing so that the electronic devices are protected.

In order to achieve the above objects, the present invention provides a fan device with a vibration attenuating structure. The fan device with a vibration attenuating structure comprises a fan and a frame covering the fan. The frame entirely covers the fan, and two opposing sides of the frame have an opening thereon. The openings are corresponding to blades of the fan to form the flowing path of the air.

Depending on the present invention, the fan device is provided on the casing for cooling the system in magnetic force or screwing manner and the frame performs as a buffer layer between the casing and the fan. Thus the noise of vibration is reduced. Moreover, the fan device can project colorful lights.

In order to better understand the characteristics and technical contents of the present invention, a detailed description thereof will be made with reference to the accompanying drawings. However, it should be understood that the drawings and the description are illustrative but not used to limit the scope of the present invention.

DETAILED DESCRIPTION OF THE PREFERRED EMBODIMENTS

Figure 1:
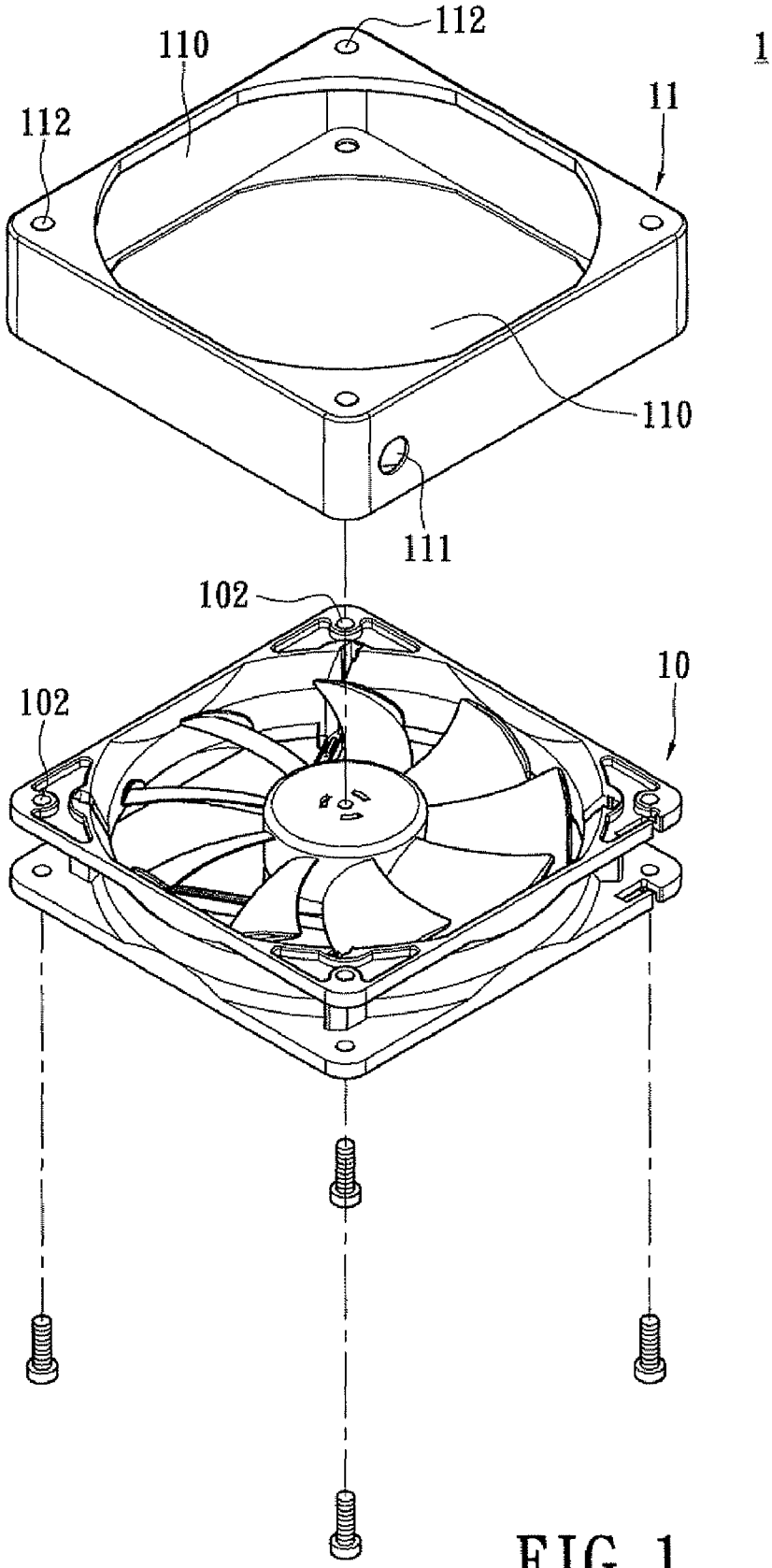
FIG. 1 is an exploded view showing the first embodiment of the fan device according to the present invention.
Figure 2:
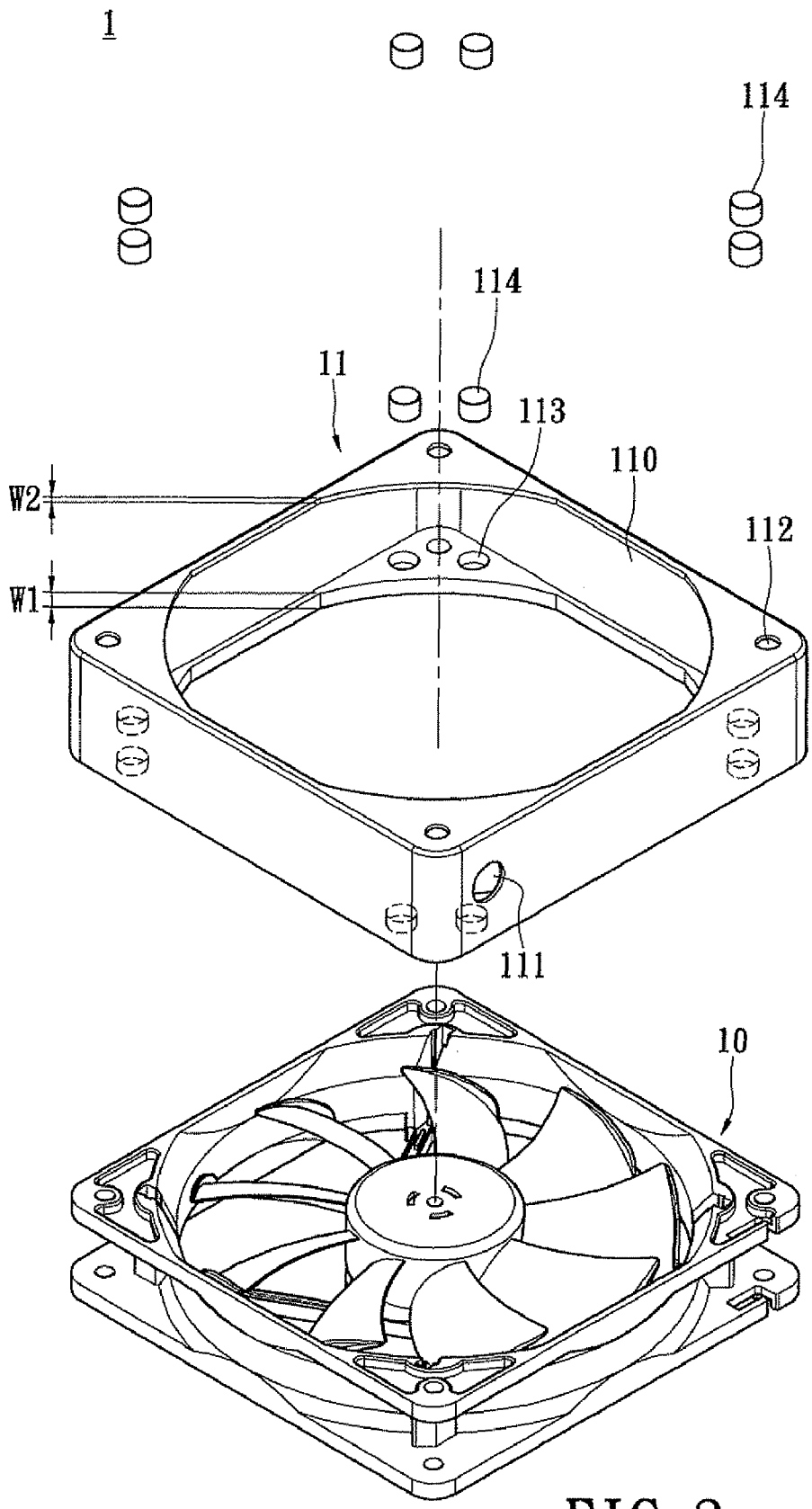
FIG. 2 is an exploded view showing the second embodiment of the fan device according to the present invention.
Figure 3:
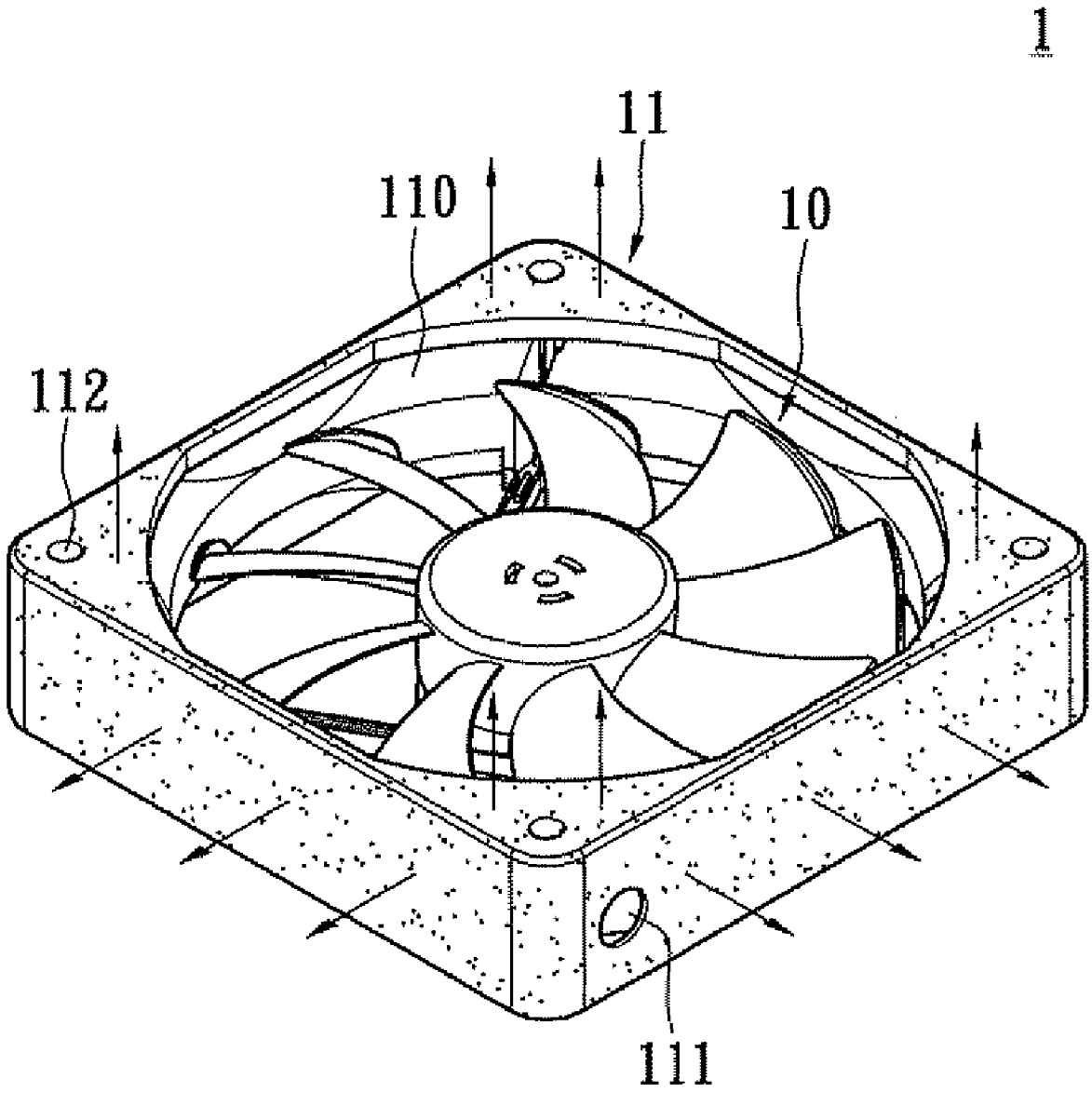
FIG. 3 shows the fan device projecting light therefrom.

Please refer to FIGS. 1 to 3; the invention discloses a fan device with a vibration attenuating structure 1. The fan device with a vibration attenuating structure 1 can be assembled on a casing so that noise is prevented because the vibration between the fan and the casing is attenuated. The fan device with a vibration attenuating structure 1 comprises a fan 10 and a frame 11, and the frame 11 covers the fan 10. In other words, the frame 111 entirely covers the fan 10 and the frame 111 has two openings 110 for air flow. The two openings 110 are defined on two opposing sides of the frame 11 and the two openings 110 on the opposing sides of the frame 11 are corresponding to the inlet and the outlet of the fan 10.

Figure 1A:
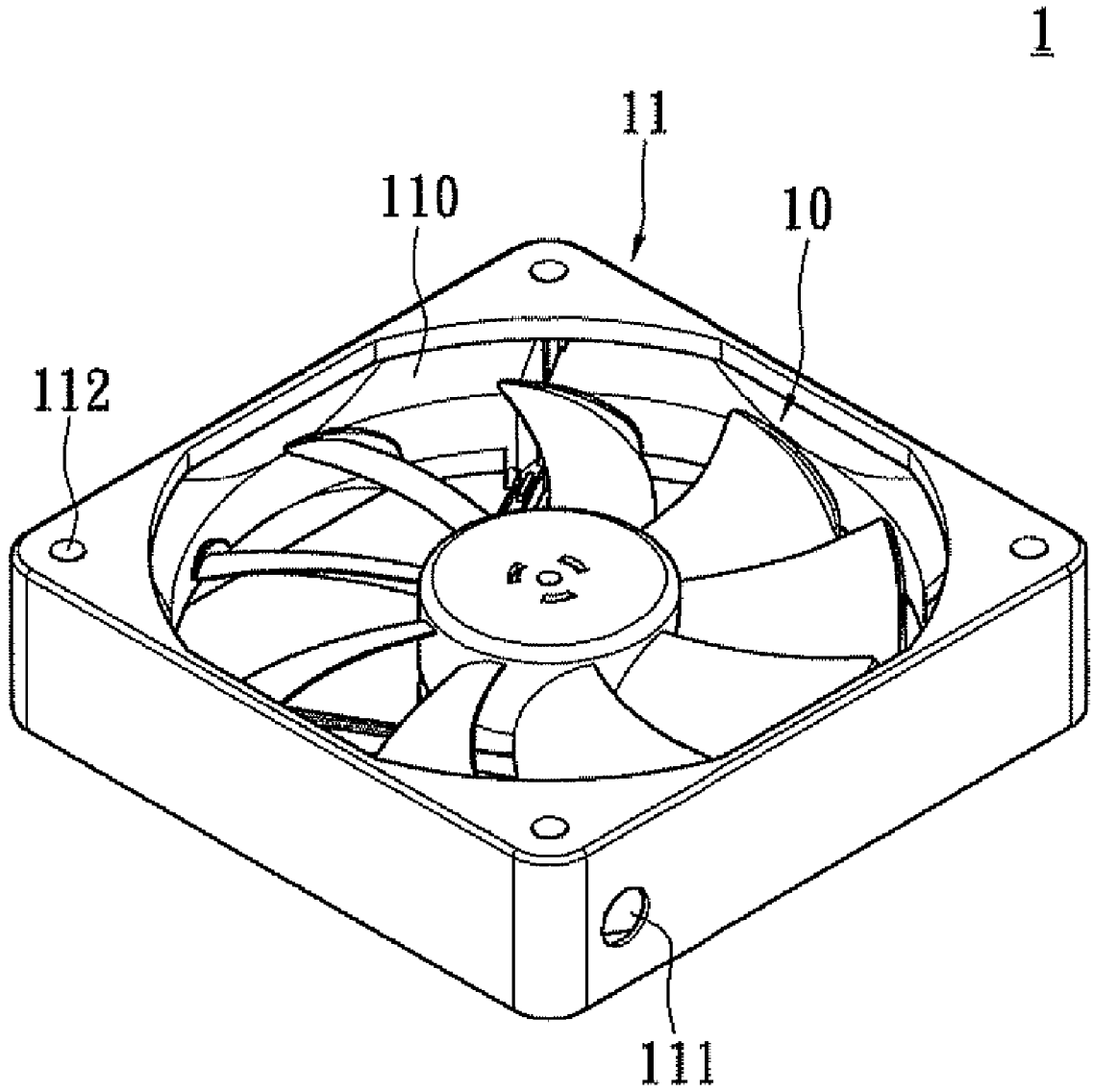
FIG. 1A is a schematic view showing the first embodiment of the fan device according to the present invention.

Please refer to FIG. 1 and FIG. 1A again; the fan device with a vibration attenuating structure 1 is assembled on a computer casing, and the fan 10 is a cooling device for computer The fan 10 can has various sizes, such as 80 mm*80 mm, 92 mm*92 mm, 120 mm*120 mm, and so on. The size of the frame 11 is corresponding to the size of the fan 10 so as to cover the fan 10 entirely and tightly. Both of two opposing sides of the frame 11 have an opening 110 thereon and the size, shape, and position of the opening 110 are corresponding to the blades of the fan 10 in order to achieve smooth air flow. However, the sizes of the opening 110 can be the same with each other or one opening 110 is larger than the other. In the embodiment, the frame 11 can be made by elastic material, for example, silicone so that the frame 11 can perform as a sheath for tightly covering the fan 10. The frame 11 further has at least one through hole 111 so that the conduct line of the fan 10 can be electrically plug on the socket via the through hole 111.

Furthermore, the fan 10 further has at least one first fixing hole 102 and the frame 11 further has at least one second fixing hole 112 for fixing the fan device with a vibration attenuating structure 1 on the computer casing. The first fixing hole 102 is corresponding to the second fixing hole 112. In the embodiment the fan 10 has rectangular shape and each of the four corners of the fan 10 has a first fixing hole 102. Similarly, the each of the four corners of the frame 11 has a second fixing hole 112. Thus, the fan device with a vibration attenuating structure 1 can be fixed on the computer casing by screws though the corresponding first and second fixing holes for dissipating heat of computer. When the fan 10 is operating, the frame 11 can be used for vibration attenuating of the fan 10 and the noise generated by resonance of the computer casing and the fan 10 is prevented.

FIG. 2 shows the second embodiment of the present invention. The fan device with a vibration attenuating structure 1 is fixed on the computer casing by magnetic force in the second embodiment. Therefore, the frame 11 has at least one magnetic unit 114 thereon for fixing the fan device with a vibration attenuating structure 1 on the computer casing.

In the second embodiment, one of the two sides of the fan with the openings 110 has at least one hole 113, and at least one magnetic unit 114 is disposed in the hole 113. The hole 113 can be a through hole or a blind hole. Please refer to FIG. 2, there are two holes 113 defined on a wall at the two opposing sides of the frame 111 and a magnetic unit 114 is fastened into a holes 113 so that the fan device with a vibration attenuating structure 1 is fixed on the computer casing via the two magnetic unit 114 for dissipating heat of computer.

Moreover, the thickness of the frame 111 is even for saving the material and lowering the weight of the frame 11 in the first embodiment. On the other hand, the wall of the frame 11 with the magnetic unit 114 is thicker than the wall at the opposite side of the frame 14 for fastening the magnetic unit 114 tightly. In other words, the wall of the frame 11 with the magnetic unit 114 has thickness W1 and the other wall without the magnetic unit 114 has thickness W2. W1 is larger than W2 in order to fasten the magnetic unit 114 tightly. Using the magnetic unit 114, the fan device with a vibration attenuating structure 1 can be easily assembled on/disassembled form the computer casing.

The fan device with a vibration attenuating structure 1 of the first and the second embodiment can be modified. The fan 10 further has at least one lighting unit, such as an LED. In accordance with the color of the LED, the frame 11 can be semi-transparent or with colors so that the fan device with a vibration attenuating structure 1 can show colorful effect. The conductive line of the lighting unit also can electrically connect to the power supply via the through hole 111 of the frame 11. In another application, lighting materials, such as fluorescent powders can be added in the silicon material made of the frame 11 so that the frame 11 can project color light in dark environment (shown in FIG. 3). On the other hand, the fluorescent powders can be added into the partial portion or entire portion of the frame 11.

Figure 4:
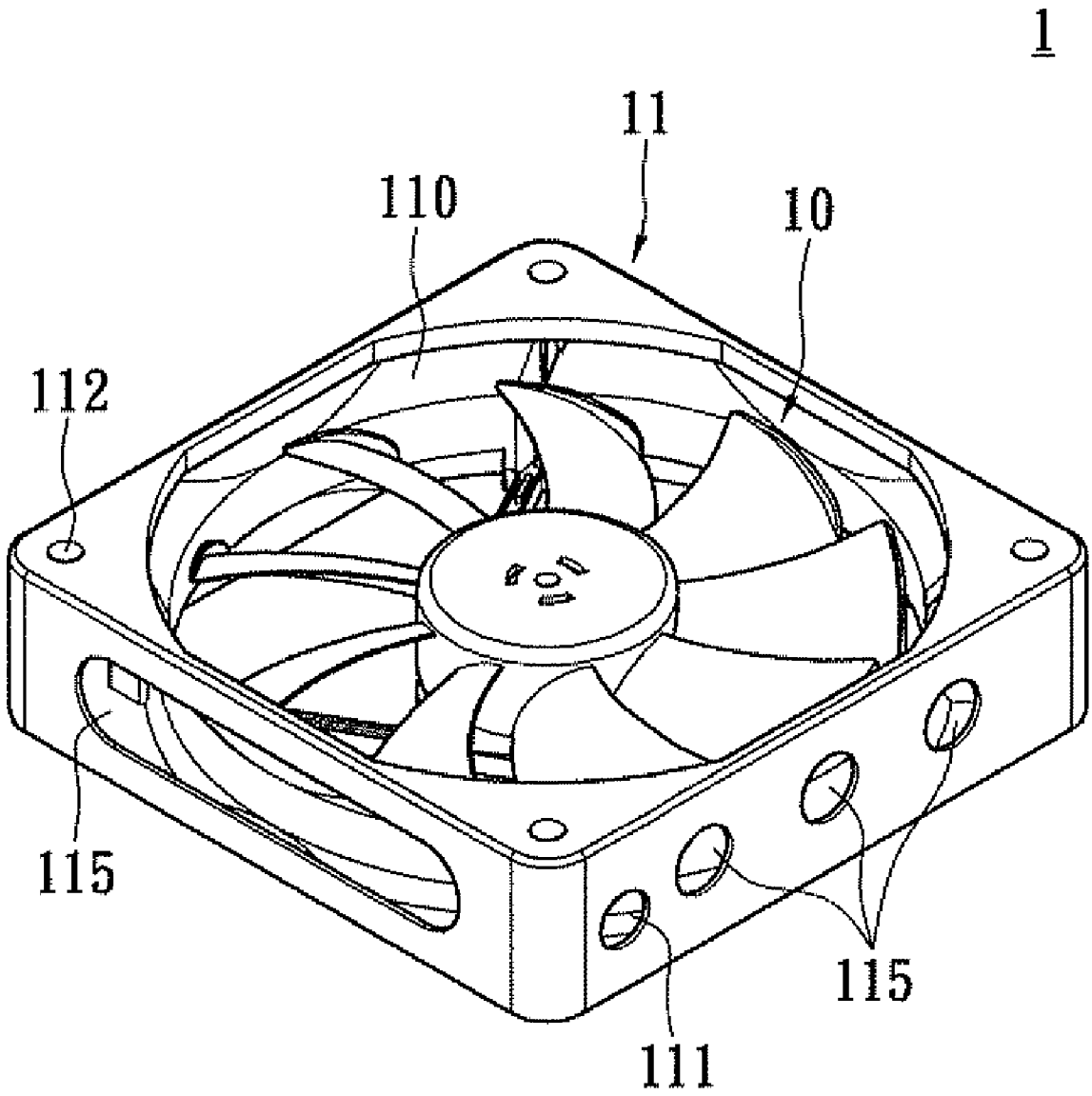
FIG. 4 shows the third embodiment of the fan device according to the present invention.

In addition, FIG. 4 shows the third embodiment of the present invention. The frame 11 further comprises at least one auxiliary hole 115 on the side thereof for saving the elastic material. The position, size and shape are not restricted.

Figure 5:
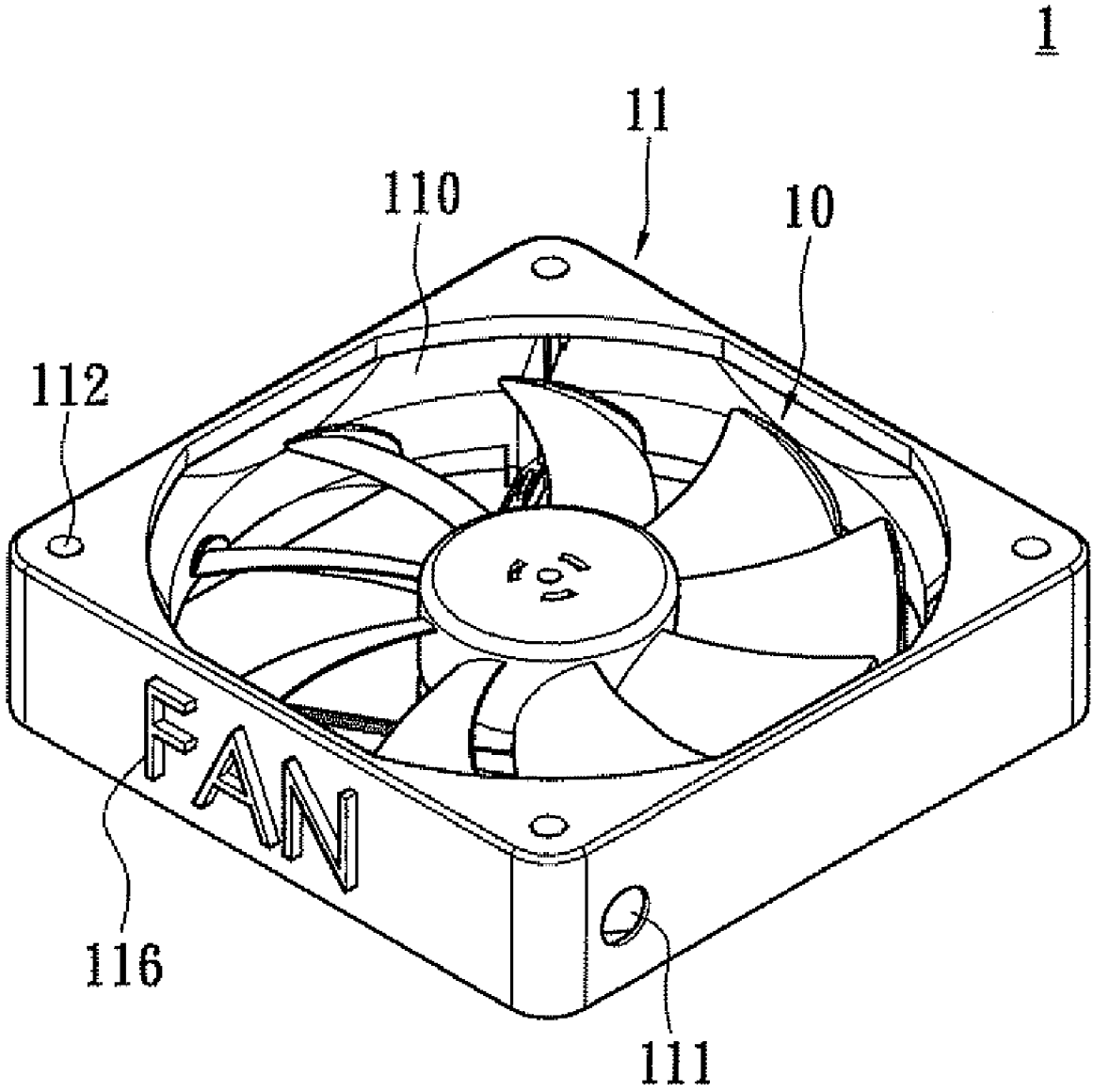
FIG. 5 shows the fourth embodiment of the fan device according to the present invention.

FIG. 5 shows the fourth embodiment of the present invention. The frame 11 further comprises at least one pattern 116 on the side thereof. The pattern 116 represents words, trademark, and so on. In FIG. 5, the pattern 116 of "FAN" is made by printing method or injection molding method on the frame 11.

To sum up, the present invention has the following advantages:

1. The elastic frame is applied for entirely holding the fan so that the vibration of the fan can be attenuated by the frame. Thus the noise of the resonance of the fan and the casing is prevented. Moreover, when the fan is operating the solid sound generated by the casing is attenuated. In other words, the frame performs as an isolation layer for isolating the fan so as to reduce the noise.
2. The frame fits the size of the common fans and the fan device with a vibration attenuating structure can be easily assembled on and disassembled from the casing. In other words, it is convenient for assembling the fan device on the computer casing so as to cooling the computer system.
3. The fan device with a vibration attenuating structure of the present invention can project colorful lights for increasing the addition value of the fan structure.

Although the present invention has been described with reference to the foregoing preferred embodiment, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. A fan device with a vibration attenuating structure, comprising:

a fan having blades and having walls to form a fan frame surrounding the blades; and a sheathing frame for receiving the fan therein, the sheathing frame entirely enclosing the fan frame, each of two opposing sides of the sheathing frame having an opening to expose the blades of the fan.

2. The fan device according to claim 1, wherein the sheathing frame further has at least one through hole for a wire of the fan passing through.

3. The fan device according to claim 1, wherein the fan has at least one first fixing hole formed on the fan frame, the sheathing frame has at least one second fixing hole, and the first fixing hole is corresponding to the second fixing hole so that a screw is passed through the first and the second fixing holes to secure the fan and the sheathing frame together.

4. The fan device according to claim 3, wherein the fan frame and the sheathing frame have corners, and each of the corners of the fan frame has the first fixing hole, and each of the corners of the sheathing frame has the second fixing hole.

5. The fan device according to claim 1, wherein one of the two opposing sides of the sheathing frame has at least one magnetic unit.

6. The fan device according to claim 5, wherein a wall on the two opposing side of the sheathing frame has at least one hole, and the magnetic unit is disposed inside the hole.

7. The fan device according to claim 6, wherein the wall of the sheathing frame with the magnetic unit is thicker than the other wall at the opposite side of the sheathing frame.

8. The fan device according to claim 1, wherein the fan further has a lighting unit.

9. The fan device according to claim 1, wherein the sheathing frame is made of elastic material.

10. The fan device according to claim 1, wherein the sheathing frame is a silicon frame added with fluorescent powders so that the sheathing frame projects color light in dark environment.

11. The fan device according to claim 1, wherein two openings at the opposing sides of the sheathing frame are corresponding to an inlet and an outlet of the fan, respectively.

12. The fan device according to claim 1, wherein the sheathing frame further comprises at least one auxiliary hole.

13. The fan device according to claim 1, wherein the sheathing frame further comprises at least one pattern thereon.

* * * * *